US010807617B1

(12) United States Patent
Bazinet et al.

(10) Patent No.: US 10,807,617 B1
(45) Date of Patent: Oct. 20, 2020

(54) ANTI-SEISMIC RETAINING SYSTEM FOR A MASS TRANSIT VEHICLE

(71) Applicant: Bombardier Transportation GmbH, Berlin (DE)

(72) Inventors: David Bazinet, Mont-St-Hilaire (CA); Louis Dumoulin, Marieville (CA)

(73) Assignee: Bombardier Transportation GmbH, Berlin (DE)

( * ) Notice: Subject to any disclaimer, the term of this patent is extended or adjusted under 35 U.S.C. 154(b) by 0 days.

(21) Appl. No.: 16/860,274

(22) Filed: Apr. 28, 2020

(51) Int. Cl.
*B61F 9/00* (2006.01)

(52) U.S. Cl.
CPC ..... *B61F 9/00* (2013.01)

(58) Field of Classification Search
CPC .. B61F 9/00; B61F 9/005; B61F 11/00; B61F 13/00; E01B 25/00; B61B 5/02; B60F 1/00; B60F 1/005; B60F 1/02; B60F 1/04; B60F 1/043; B60F 1/046
See application file for complete search history.

(56) References Cited

U.S. PATENT DOCUMENTS 9,061,690 B2 * 6/2015 Kanemori ..... B61B 13/00
2008/0083345 A1 * 4/2008 Morita ..... B62D 1/265 104/106
2009/0320713 A1 * 12/2009 Amiri ..... B62D 55/06 104/281
2012/0000391 A1 * 1/2012 Maeyama ..... B62D 1/265 105/182.1
2012/0037715 A1 * 2/2012 Sakanoue ..... B61F 9/00 238/17
2015/0015017 A1 * 1/2015 Benoliel ..... B62D 63/025 296/26.02
2015/0353104 A1 * 12/2015 Maeyama ..... B61F 5/50 701/19
2016/0272222 A1 * 9/2016 Katahira ..... B61F 3/16
2016/0355059 A1 * 12/2016 Katahira ..... B60C 7/00
2019/0300023 A1 * 10/2019 Ren ..... B61C 3/02
2019/0344810 A1 * 11/2019 Ren ..... B61F 5/00

* cited by examiner

*Primary Examiner* — Jason C Smith
(74) *Attorney, Agent, or Firm* — The Webb Law Firm

(57) ABSTRACT

A retaining system for a mass-transit vehicle adapted to travel on a guideway includes a longitudinal retaining track having two retaining rails. Each retaining rail has a projection projecting inwardly toward the other retaining rail. A grabbing mechanism of the mass-transit vehicle has grabbing portions extending outwardly underneath the projections of the retaining rails. The grabbing portions are pivotally and resiliently connected to a wheelset of the mass-transit vehicle proximate a midplane of the body. When the mass-transit vehicle rolls on one side past a predetermined angle, an opposite one of the grabbing portions is operative to contact a corresponding one of the horizontal projections. The roll of the mass-transit vehicle is thereby gradually stopped under a force developed by a corresponding resilient element.

10 Claims, 3 Drawing Sheets

ANTI-SEISMIC RETAINING SYSTEM FOR A MASS TRANSIT VEHICLE

CROSS-REFERENCE TO RELATED APPLICATION

The present application claims priority to Canadian Patent Application No. 3,048,377, filed Jun. 28, 2019, the disclosure of which is hereby incorporated by reference in its entirety.

BACKGROUND OF THE DISCLOSURE

Field of the Disclosure

The present disclosure generally relates to the field of mass transit vehicles. More specifically, the disclosure relates to a retaining system for a mass transit vehicle operating on an elevated guideway capable of retaining the vehicle on its guideway in case of an earthquake.

Description of the Related Art

Over the years, many solutions have been proposed to prevent rail vehicles from derailing. However, many suggested solutions may potentially damage the vehicle while conducting their purpose, or are not practical for use in a vehicle travelling on a guideway.

There is therefore a need for an improved retaining system for a mass transit vehicle.

SUMMARY OF THE DISCLOSURE

It is an object of the present disclosure to provide a retaining system for a mass-transit vehicle that overcomes or mitigates one or more disadvantages of known retaining systems, or at least provides a useful alternative.

The disclosure provides the advantages of being compact, not laterally extending outside of a vehicle's wheelset and of progressively transferring a load to the wheelset, thereby preventing as much as possible the integrity of the wheelset.

In accordance with some non-limiting embodiments or aspects of the present disclosure, there is provided a retaining system for a mass-transit vehicle adapted to travel on a guideway. The retaining system may include a longitudinal retaining track attached to the guideway, a grabbing mechanism connected to the wheelset of the mass-transit vehicle and a left and a right resilient elements. The retaining track may have a left and a right retaining rails running parallel to each other where each retaining rail has a projection projecting inwardly towards the other retaining rail. The grabbing mechanism may have a left and a right grabbing portion projecting outwardly and extending respectively underneath their respective projections of the left and the right retaining rails. Each one of the left and the right grabbing portions may be pivotally connected to the wheelset at a respective one of a left and a right pivots respectively pivoting on a respective one of a left and a right longitudinal axes proximate a midplane of the mass-transit vehicle. The left and the right resilient elements may be respectively connected between the left and right grabbing portions and the wheelset. When the mass-transit vehicle rolls on one side past a predetermined angle, an opposite one of the left and right grabbing portions may be operative to engage a corresponding one of the left and right horizontal projections, the roll of the mass-transit vehicle being thereby gradually stopped under a force developed by a corresponding one of the left and right resilient elements.

Optionally, the corresponding one of the left and right resilient elements may compress as the mass-transit vehicle rolls.

The longitudinal retaining track, the grabbing mechanism and the left and right resilient elements may be laterally located between a left and a right load wheels of the wheelset.

The left and the right load wheels may be equipped with tires. When the left or the right tire breaks contact with the guideway, the corresponding one of the left and the right grabbing portion may be operative to contact the corresponding one of the left and right retaining rail projection.

In accordance with some non-limiting embodiments or aspects of the present disclosure, there is provided a mass-transit vehicle adapted to travel on a guideway equipped with a longitudinal retaining track. The retaining track may be made of a left and a right retaining rail where each retaining rail has a projection projecting inwardly toward the opposed retaining rail. The mass-transit vehicle may have a body adapted to carry passengers, at least one wheelset having at least one left and one right load wheels, a grabbing mechanism and a left and a right resilient elements. The wheelset may support the body. The grabbing mechanism may be connected to the at least one wheelset. The grabbing mechanism may have a left and a right grabbing portions configured to extend outwardly respectively underneath the respective projection of the left and the right projections of the retaining rails. Each one of the left and the right grabbing portions may be pivotally connected to the wheelset at a respective one of a left and a right pivots respectively pivoting on a respective one of a left and a right longitudinal axes which are proximate a midplane of the body. The left and the right resilient elements may be respectively connected between the wheelset and the left and right grabbing portions. When the mass-transit vehicle rolls on one side past a predetermined angle, an opposite one of the left and right grabbing portions may be operative to contact a corresponding one of the left and right horizontal projections. The roll of the mass-transit vehicle may be thereby gradually stopped under a force developed by a corresponding one of the left and right resilient elements.

In accordance with some non-limiting embodiments or aspects of the present disclosure, the corresponding one of the left and right resilient elements may compress as the mass-transit vehicle rolls.

In accordance with some non-limiting embodiments or aspects of the present disclosure, the grabbing mechanism and the left and right resilient elements may be laterally located between the left and the right load wheels.

Optionally, the mass-transit vehicle may further include a guiding system longitudinally located along the guideway between the left and the right load wheels.

The left and the right load wheels may be equipped with tires. When the left or the right tire breaks contact with the guideway, the corresponding one of the left and the right grabbing portion may be operative to contact the corresponding one of the left and right retaining rail projection.

BRIEF DESCRIPTION OF DRAWINGS

These and other features of the present disclosure will become more apparent from the following description in which reference is made to the appended drawings wherein.

DETAILED DESCRIPTION OF THE DISCLOSURE

The present disclosure relates to a retaining system, and to a mass-transit vehicle equipped with such a retaining system.

Figure 1:
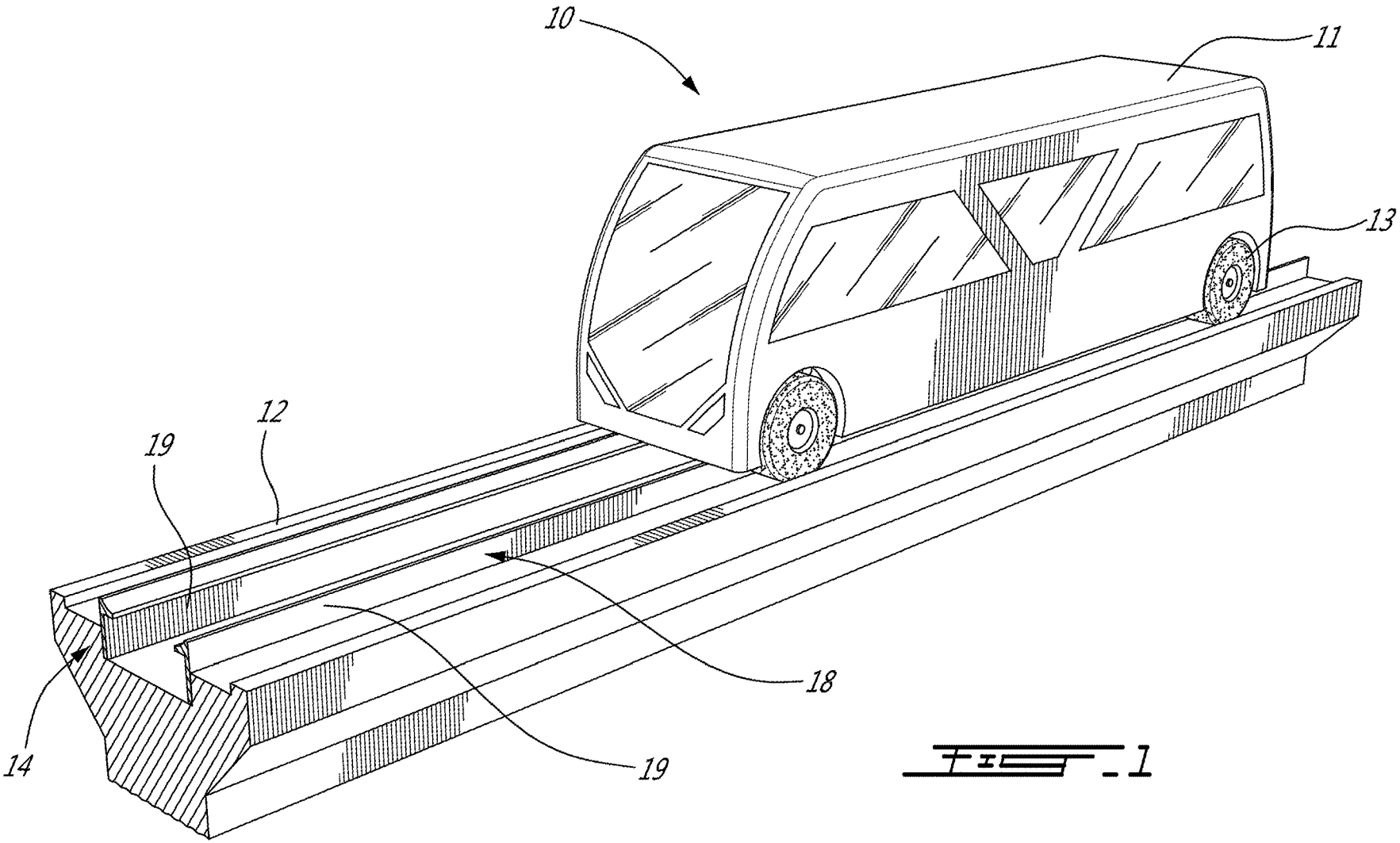
FIG. 1 is an isometric view of a mass-transit vehicle travelling along its elevated guideway in accordance with some non-limiting embodiments or aspects of the present disclosure.

FIG. 1 is now referred to. A mass-transit vehicle 10 is depicted traveling on an elevated guideway 12. Typically, Automated People Movers (APM) or monorails travel on such an elevated guideway 12. The mass-transit vehicle 10 comprises a body 11 adapted to carry passengers and at least one wheelset 13. A static or fixed portion of a retaining system 14 is attached to the guideway 12. A dynamic portion 16 of the retaining system, best shown in FIG. 2 and now concurrently referred to, is attached to an underside of the mass-transit vehicle 10. The complete retaining system, which is made of both the static portion 14 and the dynamic portion 16 of the retaining system, extends along the guideway 12 and is used to prevent the mass-transit vehicle 10 from rolling and falling off the guideway 12, for example, in case of an earthquake.

The static portion 14 of the retaining system is made of a longitudinal retaining track 18 extending along the guideway 12 and solidly attached to it. The retaining track 18 has two components: a left and a right retaining rails 19 respectively having a left and a right horizontal projections 20 projecting inwardly toward each other.

The dynamic portion 16 of the retaining system comprises a grabbing mechanism 22 and resilient elements 24. The grabbing mechanism 22 is connected to the wheelset 13 of the mass-transit vehicle 10. The grabbing mechanism 22 is equipped with a left and a right grabbing portions 28 projecting outwardly and extending respectively underneath the left and right projections 20. Each one of the left and the right grabbing portions 28, located underneath the wheelset 13, is pivotally connected to the wheelset 13 at a respective one of a left and a right pivots 29 respectively pivoting on one of a left and a right longitudinal axes 30. These longitudinal axes 30 are symmetrically located on each side of a midplane 32 of the mass-transit vehicle 10, close to the midplane 32. The longitudinal axes 30 extend along the length of the vehicle 10 and may either be parallel or coaxial (in which case they blend into a single longitudinal axis 30). The grabbing portions 28 must be solidly secured to the wheelset 13 since in case of roll over of the vehicle 10, reaction forces are channeled through it to one of the retaining rails 19.

The left and the right resilient elements 24 are respectively connected between the left and the right grabbing portions 28 and the wheelset 13. The resilient elements 24 may be either coil springs or leaf springs, elastomeric springs or any other type of adequate known resilient element capable of acting as a spring.

Figure 2:
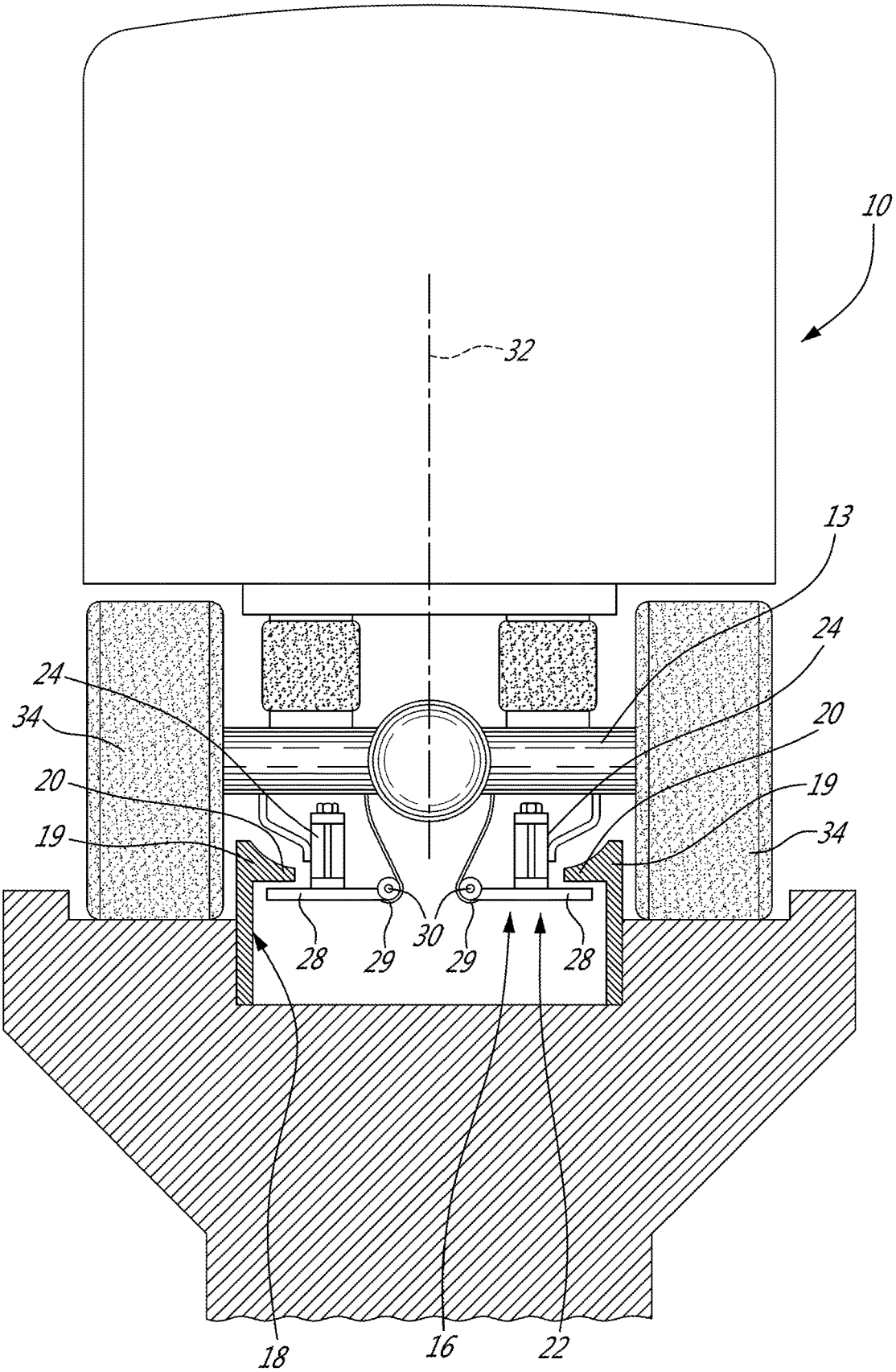
FIG. 2 is cross-sectional front view showing the mass-transit vehicle and guideway of FIG. 1.

The wheelset 13 may be equipped with either load wheels 34 made of steel (and then the guideway is equipped with steel rails to receive the steel load wheels 34) or its load wheels 34 may be equipped with tires. Tire-equipped load wheels 34 are shown in FIGS. 1-3.

Optionally, the mass-transit vehicle 10 may further comprise a guiding system installed along the guideway 12, which typically fits between the left and the right load wheels 34.

Advantageously, the whole retaining system, comprising both the static and the dynamic portions 14, 16 of the retaining system, is quite compact as it fits within the lateral distance between the left and the right load wheels 34 of the wheelset 13. In other words, the longitudinal retaining track 18, the grabbing mechanism 22 and the left and the right resilient elements 24 are laterally located between the left and the right load wheels 34.

Figure 3:
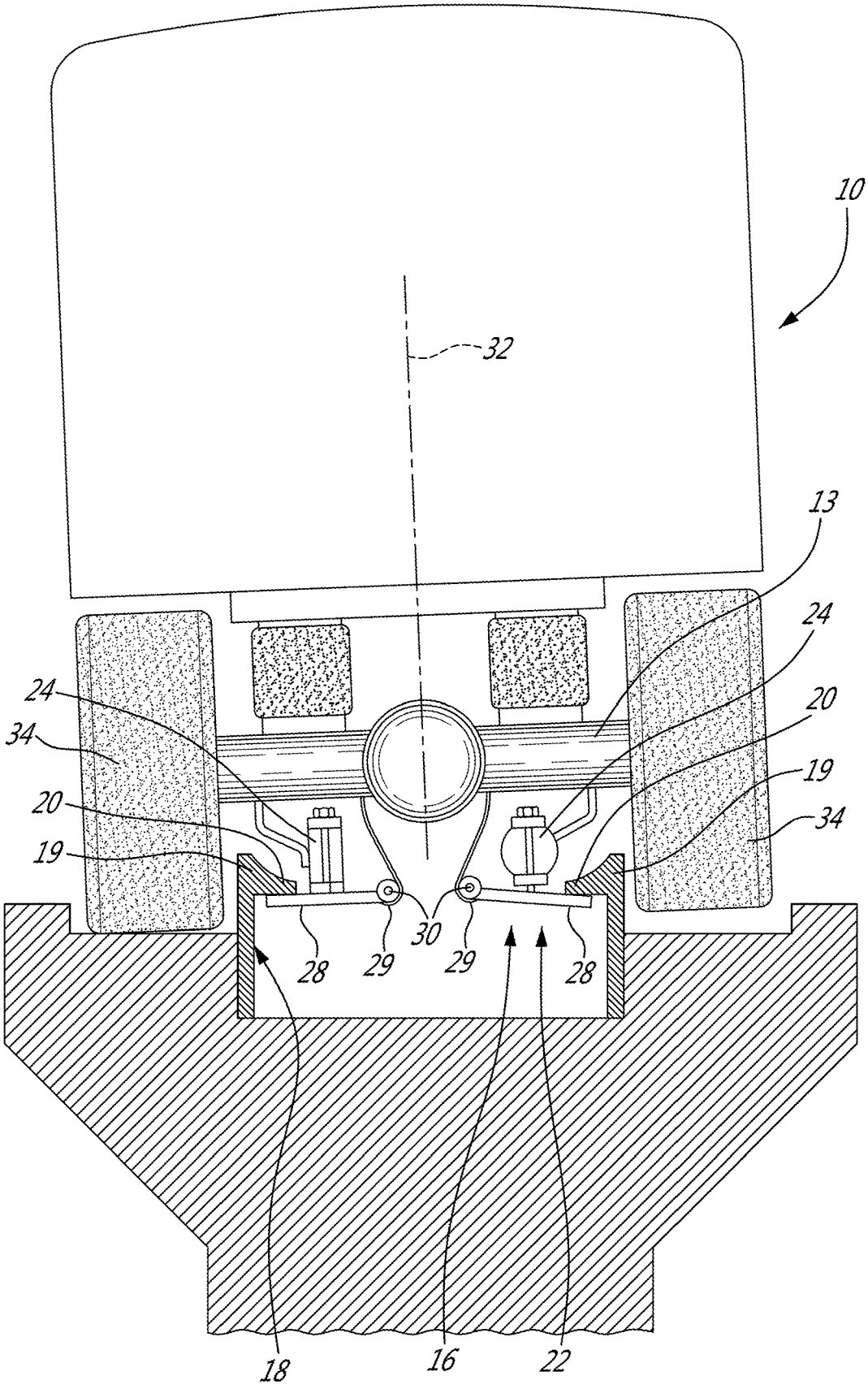
FIG. 3 is a cross-sectional front view of the mass-transit vehicle and guideway of FIG. 1 as the mass-transit vehicle rolls to one side.

FIG. 3 is now concurrently referred to. If and when the mass-transit vehicle 10 rolls on one side (for example, the vehicle 10 rolls to the left) past a predetermined angle, an opposite one of the left and right (in the example, the right one) grabbing portions 28 is operative to engage a corresponding one of the left and right horizontal projections 20 of the retaining rails 19 (in the example, the right one). The roll of the mass-transit vehicle 10 is thereby gradually stopped under a force developed by a corresponding one of the left and right resilient elements 24 (in the example, the right one). The grabbing portion 28 is typically adjusted to contact its corresponding horizontal projection 20 when or before the corresponding load wheel 34, or tire, breaks contact with the surface of the guideway 12. The resilient elements 24 advantageously soften or even eliminates an impact of the grabbing portion 28 against the projection 20. Such impacts may potentially damage the wheelset 13 and/or the guideway 12.

As can be observed, the resilient element 24 is preferably compressed when the grabbing portion 28 contacts its retaining rail 19 as the mass-transit vehicle 10 rolls.

The present disclosure has been described with regard to preferred embodiments. The description as much as the drawings were intended to help the understanding of the disclosure, rather than to limit its scope. It will be apparent to one skilled in the art that various modifications may be made to the disclosure without departing from the scope of the disclosure as described herein, and such modifications are intended to be covered by the present description. The disclosure is defined by the claims that follow.

What is claimed is:

1. A retaining system for a mass-transit vehicle adapted to travel on a guideway, the retaining system comprising:

a longitudinal retaining track attached to the guideway, said retaining track having a left retaining rail and a right retaining rail parallel to the left retaining rail, each of the left retaining rail and the right retaining rail having a projection projecting inwardly towards the other retaining rail;

a grabbing mechanism connected to a wheelset of the mass-transit vehicle, the grabbing mechanism having:

a left grabbing structure and a right grabbing structure projecting outwardly and extending respectively underneath said projections on the left retaining rail and the right retaining rail, each one of said left grabbing structure and said right grabbing structure being connected to the wheelset at a respective one of a left pivot and a right pivot respectively pivoting on one of a left longitudinal axis and a right longitudinal axis proximate a midplane of the mass-transit vehicle; and a left resilient element and a right resilient element respectively connected between said left grabbing structure and said right grabbing structure and said wheelset, wherein, when the mass-transit vehicle rolls about a longitudinal axis thereof on one side past a predetermined angle, an opposite one of said left grabbing structure and said right grabbing structure is operative to engage a corresponding one of said projections on the left retaining rail and the right retaining rail, a roll of the mass-transit vehicle being thereby gradually stopped under a force developed by a corresponding one of said left resilient element and said right resilient element.

2. The retaining system of claim 1, wherein said corresponding one of said left resilient element and said right resilient element compresses as the mass-transit vehicle rolls.

3. The retaining system of claim 1, wherein the wheelset comprises a left load wheel and a right load wheel, said longitudinal retaining track, said grabbing mechanism, and said left resilient element and said right resilient element being laterally located between the left load wheel and the right load wheel.

4. The retaining system of claim 3, wherein when one of said left load wheel and said right load wheel breaks contact with said guideway, a corresponding one of said left grabbing structure and said right grabbing structure is operative to contact a corresponding projection of one of said left retaining rail and said right retaining rail.

5. The retaining system of claim 4, wherein, when one of said left load wheel and said right load wheel breaks contact with said guideway, a corresponding one of said left grabbing structure and said right grabbing structure is operative to contact a corresponding one of said left horizontal projection and said right horizontal projection.

6. A mass-transit vehicle adapted to travel on a guideway equipped with a longitudinal retaining track having a left retaining rail and a right retaining rail parallel to the left retaining rail, said left retaining rail having a left horizontal projection and said right retaining rail having a right horizontal projection, said left horizontal projection and said right horizontal projection projecting inwardly toward each other, the mass-transit vehicle comprising:

a body adapted to carry passengers;

at least one wheelset having at least one left load wheel and one right load wheel, said wheelset supporting said body;

a grabbing mechanism connected to said at least one wheelset, the grabbing mechanism having a left grabbing structure and a right grabbing structure configured to extend outwardly respectively underneath the left horizontal projection and the right horizontal projection of the longitudinal retaining track, each one of said left grabbing structure and said right grabbing structure being connected to the wheelset at a respective one of a left pivot and a right pivot respectively pivoting on one of a left longitudinal axis and right longitudinal axis proximate a midplane of said body;

a left resilient element and a right resilient element respectively connected between said wheelset and said left grabbing structure and said right grabbing structure, wherein, when said mass-transit vehicle rolls about a longitudinal axis thereof on one side past a predetermined angle, an opposite one of said left grabbing structure and said right grabbing structure is operative to contact a corresponding one of the left horizontal projection and the right horizontal projection, a roll of the mass-transit vehicle being thereby gradually stopped under a force developed by a corresponding one of said left resilient element and said right resilient element.

7. The mass-transit vehicle of claim 6, wherein said corresponding one of said left resilient element and said right resilient element compresses as said mass-transit vehicle rolls.

8. The mass-transit vehicle of claim 6, wherein said grabbing mechanism and said left resilient element and said right resilient element are laterally located between the left load wheel and the right load wheel.

9. The mass-transit vehicle of claim 6, further comprising a guiding system longitudinally located along the guideway between said left load wheel and said right load wheel.

10. The mass-transit vehicle of claim 6, wherein said left load wheel and said right load wheel are equipped with tires.

* * * * *